United States Patent [19]

Buchanan

[11] Patent Number: 4,533,594

[45] Date of Patent: Aug. 6, 1985

[54] BATT-ON-MESH FELT EMPLOYING POLYURETHANE-COATED MULTIFILAMENTS IN THE CROSS-MACHINE DIRECTION

[75] Inventor: Robert D. Buchanan, Frankfurt, Ky.

[73] Assignee: Porritts & Spencer, Wilson, N.C.

[21] Appl. No.: 562,074

[22] Filed: Dec. 16, 1983

[51] Int. Cl.[3] ..... B32B 5/02

[52] U.S. Cl. ..... 428/236; 139/383 A; 156/148; 162/DIG. 1; 428/234; 428/235; 428/255; 428/257; 428/258; 428/259; 428/280; 428/282; 428/300

[58] Field of Search ..... 428/233, 234, 235, 257, 428/258, 259, 300, 280, 282, 255; 162/DIG. 1; 139/383 A; 156/148

[56] References Cited

U.S. PATENT DOCUMENTS 4,196,252 4/1980 Sawyer et al. ..... 156/148

4,350,731 9/1982 Siracusano ..... 428/234

*Primary Examiner*—James J. Bell

*Attorney, Agent, or Firm*—Fleit, Jacobson, Cohn & Price

[57] ABSTRACT

A papermakers' felt of the batt-on-mesh type wherein the mesh layer is a fabric formed from machine direction yarns in combination with cross-machine direction yarns. The cross-machine direction yarns are multifilament yarns with a polyurethane coating thereon.

13 Claims, 4 Drawing Figures

FIG. 1
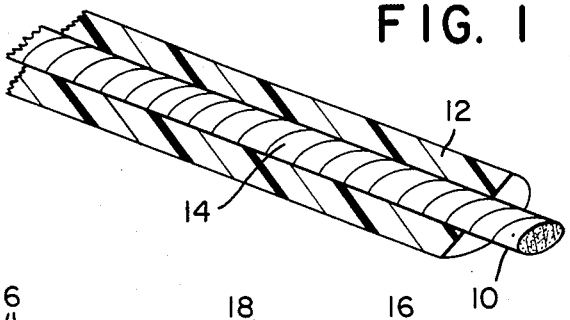
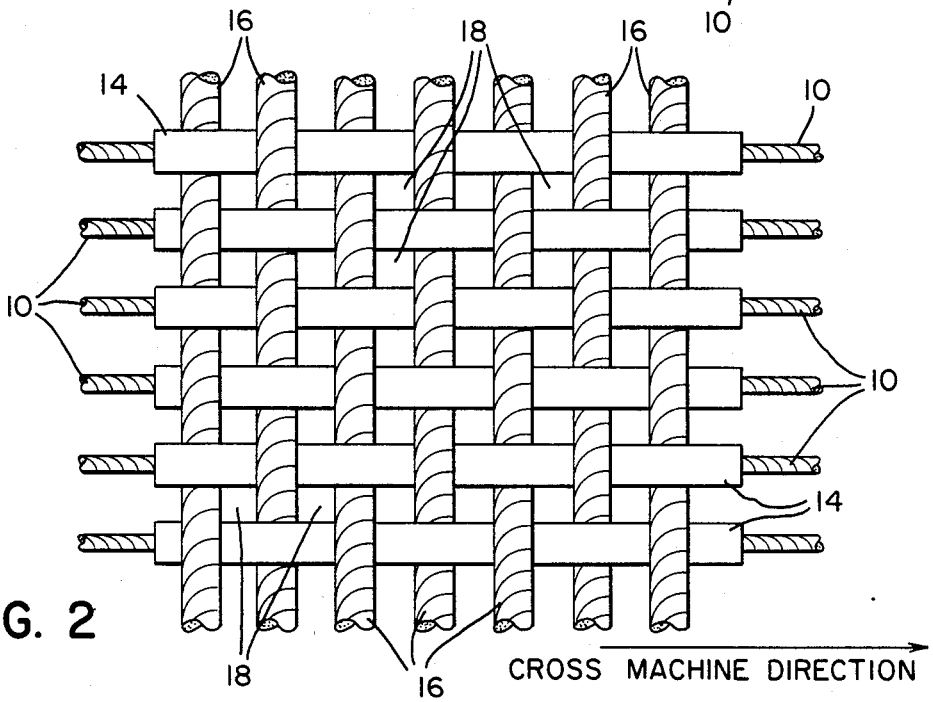
FIG. 2
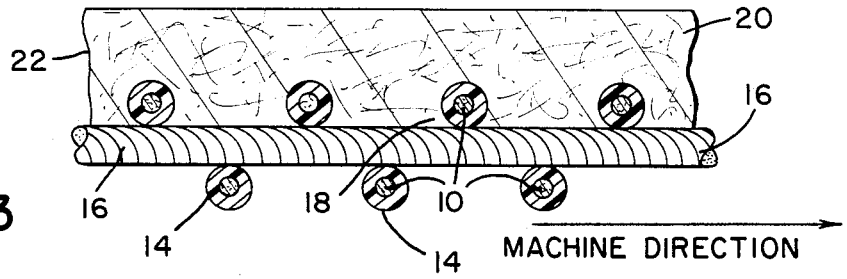
FIG. 3
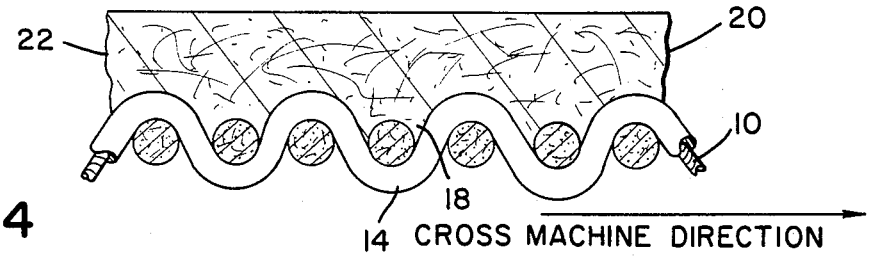
FIG. 4

BATT-ON-MESH FELT EMPLOYING POLYURETHANE-COATED MULTIFILAMENTS IN THE CROSS-MACHINE DIRECTION

BACKGROUND OF THE INVENTION

1. Field of the Invention

This invention relates to a fabric for use as the mesh layer of a batt-on-mesh papermakers' felt and more particularly, to a papermakers' felt comprising a fibrous batt attached to the mesh fabric layer by a needling process. The fabric comprises a multifilament yarn in the cross-machine direction, this multifilament yarn having a polyurethane coating thereon.

2. Description of the Prior Art

In general, press felts are used in papermaking machines to support the moist, freshly formed paper web as it encounters a variety of rolls which serve to extract water from the moist paper web. In addition to serving as a support for the paper web, the press felt serves as a receptacle for the water removed from the paper sheet.

The ideal felt should have a surface that is fine enough to produce a smooth finish and minimize marking of the sheet of paper being produced. It should also be open enough to allow water to drain through it without significant back-up. Additionally, it should be tough and strong enough to provide good stability, wear-resistance, and felt life.

Batt-on-base needled felts which consist of a batt or fleece of loosely associated non-woven fibers needled to a woven base fabric are well known to the art and possess several of the desired characteristics. Because of their relatively high drainage characteristics, these felts have been used extensively throughout the papermaking industry.

However, one problem encountered with the batt-on-base needled felts is that of excessive wear due to the abrasive action of the press rolls, felt rolls, conditioning equipment, and abrasive contaminants. These prior art felts have relatively low stability and resistance to wear and abrasion. These felts are plagued by distortion and have far shorter service lives than is desirable.

The newer batt-on-mesh felts utilize high strength twisted multifilament yarns or monofilaments. The mesh base not only has greater open area between machine and cross-machine yarns, but also resists compaction to a greater degree than the spun yarn base. However, these yarns still do not possess satisfactory felt life, having the disadvantage of reduced retention of the batt fibers and lower abrasion resistance of the mesh under certain conditions due to fibrillation of the filament surface.

In recent years, the speeds of papermaking operations have increased to the point that greater roll pressures have been necessitated, causing an increase in the tendency of felt to wear due to abrasion. In an effort to counteract the effects of the increased abrasion on the felts, particularly the mesh layer of these felts, a variety of materials have been used in the manufacture of the mesh fabric. Recently, thermoplastic monofilaments of nylon and polyester have been utilized.

Bond, U.S. Pat. No. 4,370,375, discloses a polyamide monofilament which exhibits resistance to abrasive forces applied transversely to the longitudinal dimension of the monofilament. The disclosure provides for an oriented polyamide monofilament having a diameter of about 3–30 mils and comprising filament-forming polyamide and about 3–10 weight percent, based on the total weight of the monofilament, of molybdenun disulfide. Fleischer, U.S. Pat. No. 4,093,512, discloses a papermakers' belt comprising ultra high modulous load bearing yarns which may be resin coated, or wrapped and then resin coated, to improve their abrasion resistance. Among the resins suggested for coating the high modulous yarns are acrylic resins, phenolic resins, and amino resins. The synthetic fiber to be coated or wrapped and then resin coated is a poly(paraphenylene terephthalamide). Among the materials disclosed for wrapping poly(para-phenylene terephthalamide) are asbestos, nylon, and Dacron.

Kahn, U.S. Pat. No. 4,259,394, discloses a base fabric which is utilized in conjunction with a needled batt to provide a paper machine felt. The needled fabric is subjected to a fusing operation which stabilizes the fabric and enhances the adhesion of the batt fibers to the base fabric as well as enhancing resistance of the fabric to compaction. The base fabric is composed of a core forming yarn wrapped with one or more layers of wrapping yarn. The core forming yarns are heat infusible and the wrapping yarns are heat fusible. The infusible yarns include aramid fibers, acrylic homopolymers, coated fiberglass, metallic fibers, and novoloid fibers. The fusible yarns include polyamide, polyester, olefin, and polyvinyl chloride. Also disclosed are yarns which have a core of polyester or nylon and are wrapped with polyethelene or polypropylene yarns. None of the above disclosed yarns provide the required abrasion resistance to meet the needs of the current industry standards. Accordingly, a need has continued to exist for a batt-on-mesh papermakers' felt, the abrasion resistance of which is superior to the prior art mesh bases.

SUMMARY OF THE INVENTION

It is an object of this invention to provide an improved papermakers' felt.

It is an object of this invention to provide an improved papermakers' felt of the batt-on-mesh type.

It is a further object of this invention to provide an improved papermakers' felt of the batt-on-mesh type wherein the mesh fabric has a resistance to abrasion which is superior to the prior art mesh fabrics.

It is yet a further object of this invention to provide an improved papermaker's felt of the batt-on-mesh type wherein the mesh fabric has a superior resilience as compared to the prior art mesh fabrics.

These and other objects of the invention as will hereinafter become more readily apparent, have been accomplished by preparing a papermakers' felt of the batt-on-mesh type wherein the fabric mesh layer comprises a polyurethane-coated multifilament in the cross-machine direction.

BRIEF DESCRIPTION OF THE DRAWING

FIG. 1 is a perspective view, partially cut away, of a multifilament yarn coated with a polyurethane resin.

FIG. 2 is a top plan view of a plain weave mesh layer in accordance with this invention.

FIG. 3 is a sectional view of a papermakers' wet felt, in the machine direction, in accordance with this invention.

FIG. 4 is a sectional view of a papermakers' wet felt, in the cross-machine direction, in accordance with this invention.

DESCRIPTION OF THE PREFERRED EMBODIMENT

With reference to FIG. 1, the yarn which is coated with polyurethane resin is generally designated as 10. Suitable yarns include, but are not limited to nylon yarns such as 210 denier, 3 ply (210/3), 420 denier, 3 ply (420/3) and 840 denier, 3 ply (840/3) with suitable twist in the single and the ply; typically, the twist is in the range of 6.5 to 7.0. These yarns are well known in the art. Additionally, polyester and acrylic multifilaments or other suitable yarns are within the scope of this invention.

The polyurethane resins comprising the coating 12 on the synthetic yarn are well known in the art and include, but are not limited to those thermoplastic polyurethanes which are the reaction products of polyhydroxy alcohols and diisocyantes. Preferred among the known polyurethanes for coating the yarns are those thermoplastic polyurethanes produced by the Upjohn Company under the trade name Pellathane. The preferred polyurethane is a polyether polyurethane of the Pellathane type, the 2103 series.

The polyurethane resin coating may be applied to the yarn by any of the techniques known to the art. Included among such coatings techniques are extrusion coating, dip coating, or by bath application. Surprisingly, application of the coating of polyurethane wherein the polyurethane resin is extruded onto the yarn provides abrasion resistance which is superior to that resulting from the use of other coating techniques. Therefore, the extrusion coating is the preferred coating method.

Among the various extrusion techniques known to the art, cross-head extrusion is the extrusion method of choice. Both pressure dyes, wherein the polyurethane melt is applied to the yarn under pressure within the dye, and tubing dyes, wherein the yarn and melt make contact only after the two have exited the cross-head extrusion dyes, are equally suitable for the coating process.

The resulting polyurethane-coated yarn 14 has a diameter of about 20 to 60 mils and contains about 30 to 90 weight percent polyurethane based on the weight of the yarn. A typical yarn has a diameter of 36 mils and 51 weight percent coating.

In FIG. 2, 14 represents a multifilament yarn 10 coated with polyurethane resin layer 12, oriented in the cross-machine direction. 16 represents the machine direction yarn which may be the same as or different from the yarn which is coated with polyurethane. Suitable machine direction yarns include 840 denier, 3 ply and 1050 denier, 3 ply nylon multifilaments, suitably twisted. Spun yarns and combinations of spun and multifilament or monofilament yarns, either single or cabled and coated or not coated are also within the scope of this invention. Additionally other suitable synthetic or natural yarns can be employed as mentioned above, including polyester and acrylic multifilaments.

Techniques for fabricating mesh based fabrics from yarn are well known to the art. The mesh based fabrics are of the woven type. Any of the conventional weaving patterns known to the art are contemplated as within the scope of this invention, the polyurethane-coated yarns being used in the cross-machine direction. Useful weave patterns include twill, plain, duplex and satin weave configurations. Because the cross-machine direction yarn knuckles protrude from the plane of the fabric, particularly in those felt designs which require that there be very little batt on the underside of the felt, the cross-machine yarns tend to abrade and therefore wear out first. The coated yarns have increased resistance to wear through abrasion, thereby resulting in yarns having longer life.

Additionally, in another embodiment of the invention, the polyurethane coated yarn may be used as the machine direction yarn as well.

A typical fabric is comprised of a cross-machine direction yarn which is an 840/3 denier nylon having 16.3S/8.5Z twist, coated with polyurethane, and a machine direction yarn which is a 1050/3 denier nylon with 12.3Z/6.0S twist, said machine and cross-machine direction yarns woven in a plain weave or broken twill weave pattern and having 13 ends per inch in the machine direction and 15 ends per inch in the cross-machine direction.

These polyurethane-coated yarns possess properties making then uniquely suited for mesh fabric bases for papermakers' felts. Most importantly, the felts produced by the practice of this invention have resistance to abrasion which is superior to the prior art mesh bases. Additionally the coated yarns are more resilient than the uncoated yarns. This resilience results in improved stability, void maintenance and shape retention. Further, the high frictional characteristics of the polyurethane coating help to retain the needled fibers comprising the batt.

Fibrous batt materials contemplates as within the scope of this invention include, but are not limited to, natural fibers such as wool and synthetic fibers such as nylon, Dacron, Nomex, etc. These materials are well known to the art. Also included within the contemplation of the practice of this invention are combinations of synthetic and natural fibers and combinations or blends of different deniers of the same type of fibers. A typical batt material is a 100% nylon 15 denier, 3½ inch staple.

The fibrous batt material is attached to the mesh substrate by any of the methods conventionally known to the art. Preferred among the known methods is the process of needling. FIGS. 3 and 4 are sectional views of the felt 20 in accordance with this invention. FIG. 3 is a sectional view taken in the machine direction. As may be seen from the drawing, the polyurethane-coated yarn 14 is in the cross-machine direction only. FIG. 4 is a section taken in the cross-machine direction. The machine direction yarn 16 is not coated. Each sectional view of the felt 20 shows the fibrous batt 18 in combination with a woven base 14.

Following the attachment of the fibrous batt to the mesh base, the resulting felt may be subjected to heat treatment. Typically the felt is stretched between two rolls and heated by suitable means known to the art such as infra red, hot air or a hot roll. The heat treatment provides additional dimensional stability.

Having now fully described the invention it will be apparent to one of ordinary skill in the art that many changes and modifications can be made thereto without departing from the spirit and scope of the invention as set forth herein.

What is claimed:

1. A papermakers' felt of the batt-on-mesh type wherein each strand of yarn woven in the cross-mchine direction of the mesh layer of said papermakers' felt comprises a yarn coated with a solid layer of polyurethane in such a manner that said yarn is hard, non-resilient and resistant to abrasion.

2. The felt of claim 1 wherein said yarn is a multifilament yarn.

3. The felt of claim 2 wherein said multifilament yarn is a yarn selected from the group consisting of nylon, polyester and acrylic yarns.

4. The felt of claim 1 wherein the polyurethane is coated on the yarn by an extrusion process.

5. The felt of claim 1 wherein the polyurethane coated yarn is in both the machine and cross-machine direction.

6. The felt according to claim 1 wherein the batt is a fibrous batt.

7. The felt according to claim 6 wherein said fibrous batt comprises a natural fiber, a synthetic fiber, or mixtures of the two.

8. A method for making a fabric suitable for use as the mesh layer of a batt-on-mesh papermakers' felt, said process comprising:

(1) coating a multifilament yarn with a solid layer of polyurethane in such a manner that said yarn is hard, non-resilient and resistant to abrasion;

(2) forming a mesh base comprising machine and cross-machine yarns, the polyurethane-coated yarns of (1) comprising said cross-machine yarns.

9. A method for making a papermakers' felt comprising:

(1) coating a multifilament yarn with a solid layer of polyurethane in such a manner that said yarn is hard, non-resilient and resistant to abrasion;

(2) forming a mesh base comprising machine and cross-machine yarns, the polyurethane-coated yarns (1) comprising said cross-machine yarns;

(3) attaching a fibrous batt material to said mesh base to form a felt.

10. The method of claim 9 further comprising a heat treating step.

11. The method of claim 9 wherein the multifilament yarn of (1) is selected from nylon, polyester, and acrylic yarn.

12. The method of claim 11 wherein said multifilament yarn of (1) is nylon yarn.

13. The method of claim 9 wherein both the machine direction yarn and the cross-machine direction yarn of (2) are comprised of polyurethane coated yarns.

* * * * *